US005209677A

United States Patent [19]

Bricaud

[11] Patent Number: 5,209,677

[45] Date of Patent: May 11, 1993

[54] SHIELDED ELECTRICAL CONNECTOR ELEMENT

[75] Inventor: Hervé Bricaud, Dole, France

[73] Assignee: ITT Composants et Instruments, Bagneux, France

[21] Appl. No.: 869,754

[22] Filed: Apr. 16, 1992

[30] Foreign Application Priority Data

Apr. 30, 1991 [FR] France ..... 9105306

[51] Int. Cl.[5] ..... H01R 13/648

[52] U.S. Cl. ..... 439/607; 439/588

[58] Field of Search ..... 439/548, 556, 559, 588, 439/607, 609, 610, 901, 904, 905

[56] References Cited

U.S. PATENT DOCUMENTS 4,464,540 8/1984 Reeder ..... 439/610 X
4,772,212 9/1988 Sotolongo ..... 439/98
4,886,463 12/1989 Scott et al. ..... 439/89
4,921,441 5/1990 Sauder ..... 439/610 X
4,974,075 11/1990 Nakajima ..... 439/610 X

FOREIGN PATENT DOCUMENTS 0371218 9/1989 European Pat. Off. .

*Primary Examiner*—Larry I. Schwartz
*Assistant Examiner*—Khiem Nguyen
*Attorney, Agent, or Firm*—Thomas L. Peterson

[57] ABSTRACT

The invention provides an electrical connector element (10) of the type comprising an insulating block (12) which receives electrical contact elements (14) which extend through the insulating block and a metal shielding cover which at least partially surrounds the insulating block in the front region of the latter, which region is provided in order to be joined with the corresponding part of a complementary connector element, characterized in that it comprises a cap (36) in insulating material which is attached to the front part (18) of the said shielding cover.

3 Claims, 2 Drawing Sheets

SHIELDED ELECTRICAL CONNECTOR ELEMENT

Figure 2:
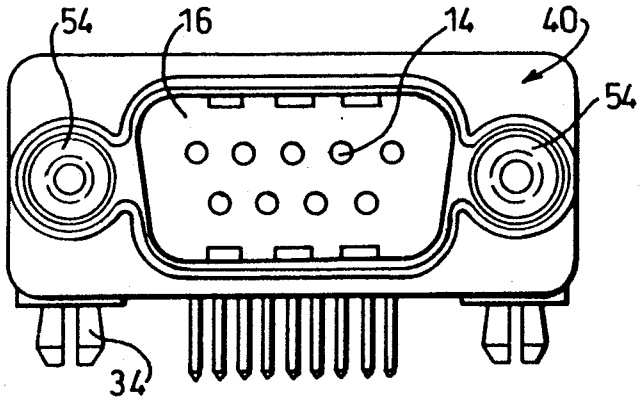

The present invention relates to an electrical connector element of the type comprising an insulating block which receives electrical contact elements which extend through the insulating block and a metal shielding cover which at least partially surrounds the insulating block in the front region of the latter, which region is provided in order to be joined with the corresponding part of a complementary connector element.

Such a type of connector element is used, for example, in a set of connectors designed for connecting different components of the transmission networks called terrain bus networks.

In these applications the earth and shielding continuity of the electrical links and of the associated connectors is vital for the correct operation of the system.

Finally, as the shielding of each link starts and stops respectively at the site of the connection to the electronic management rack of the system and of the subscriber's sensor, it can be envisaged for the housing of the fixed connector which projects from the metal panel of the rack (or of the cabinet) to be entirely plastic and for the shielding to be joined to the earth of the printed circuit by a simple electrical continuity, by means of locking screws and metal brackets for example.

However, in certain instances of use and due to the extreme sensitivity of the digital links of bus systems to electrostatic discharges, it is necessary to extend the shielding up to the front face of the fixed connector projecting from the site of the metal panel which surrounds it.

This part of the shielding makes it possible to absorb these electrostatic discharges which are then conveyed to the electrical earth of the system and to prevent them penetrating through the cutout of the panel (for passage of the fixed connector) and disturbing the internal electronics.

Moreover, the possibilities and the measures for earthing at each joining and connection point are determined on the basis of the site where this connection point within the network is situated, and differ according to whether a start or an end of a line, or an intermediate site, is involved. The direct earthing of the shielding is thus not always possible at the site of each connector and it is thus necessary, in order to guarantee the safety of the user personnel (against lightning strike especially, as these links can reach several kilometers) to effectively and completely insulate all the metal parts providing the shielding of the connectors.

One known possibility for electrically insulating metal parts of connector element housings consists in coating them by overmoulding a coating in plastic material or an insulating paint. It is equally possible to produce the whole of the housing in plastic material whilst including a metal shielding cover in it.

It is noted, however, that these techniques are costly and complex to implement and that they do not make it possible to produce insulation of connector housing elements already put in place and joined in complex user system structures.

In order to remedy these drawbacks, the invention provides a connector element of the type mentioned above, characterized in that it comprises a cap in insulating material which is attached to the front part of the said shielding cover.

According to other characteristics of the invention:

the metal shielding cover is produced in the form of a front half-shell and of a rear half-shell, and the insulating cap surrounds the front half-shell;

the front half-shell comprises an axial, skirt-shaped portion which extends substantially from the front face of the insulating block to surround the connection region of the electrical contact elements and a radial, plate-shaped portion which extends in a plane perpendicular to the axes of the electrical contact elements, the said plate being connected to the complementary plate of the rear half-shell, and the insulating cap comprises axial, skirt-shaped and radial, plate-shaped parts which surround the corresponding parts of the front half-shell, the plate-shaped radial part of the insulating cap comprises a rear axial edge which surrounds the peripheral edges of the radial portions of the front half-shell and of the rear half-shell, and the said axial edge comprises radial lugs for fastening the cap which interact with the rear face of the plate-shaped portion of the rear half-shell, the front face of the plate-shaped portion of the front half-shell comprises metal means for coupling the connector element with the complementary connector element, and the insulating cap comprises complementary parts which surround the said coupling means, the said coupling means comprise two threaded members which extend axially from the front face of the plate-shaped portion of the front half-shell and which are arranged on either side of the skirt-shaped portion, and the insulating cap is a piece in moulded plastic material.

Figure 1:
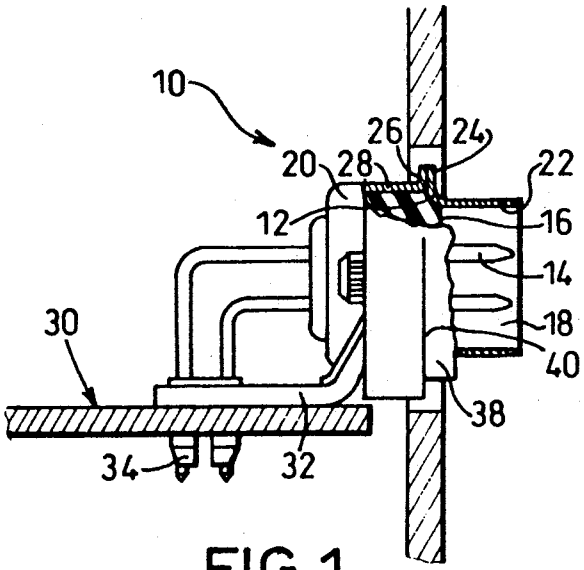
Figure 6:
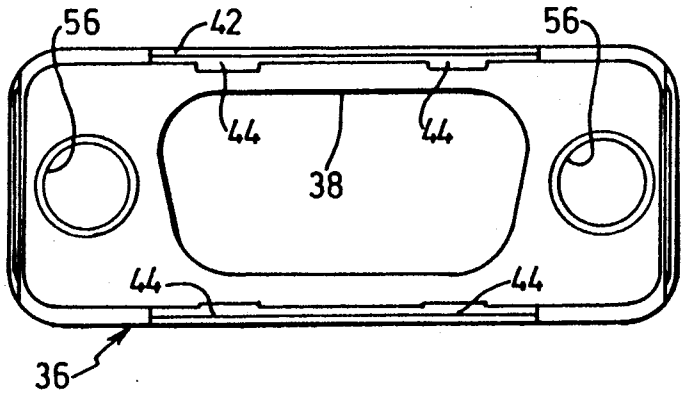
Figure 5:
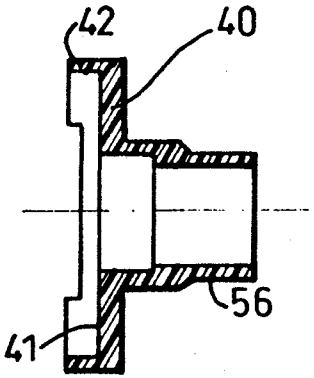
Figure 3:
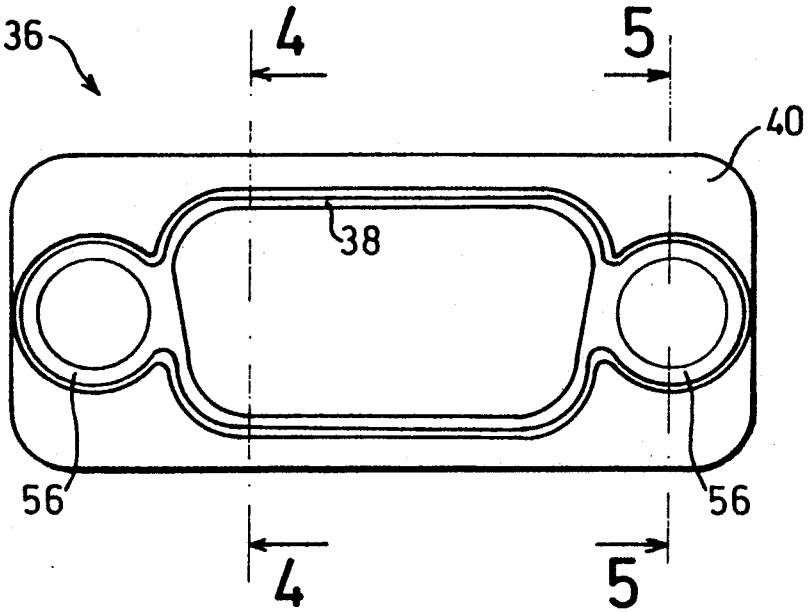
Figure 4:
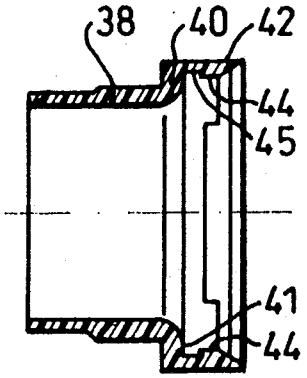

Other characteristics and advantages of the invention will appear on reading the detailed description which will follow for the understanding of which reference will be made to the attached drawing in which:

FIG. 1 is a side view in partial section of a connector element produced in accordance with the teachings of the invention, FIG. 2 is a head-on view of the connector element of FIG. 1, FIG. 3 is a front view of the insulating cap which equips the connector element of FIG. 1, FIG. 4 is a sectional view along the line 4—4 of FIG. 3, FIG. 5 is a sectional view along the line 5—5 of FIG. 3, and FIG. 6 is a rear view of the insulating cap illustrated in FIGS. 3 to 5.

In FIGS. 1 and 2 a connector element 10 of known design will be recognized.

The element 10 comprises an insulating block 12 traversed axially by electrical contact elements 14 which in the case of a male connector element extend axially beyond the front face 16 of the insulating block in order to be connected to complementary contact elements of a connector element which is not represented.

The insulating block 16 is surrounded by a shielding housing constituted by a front half-shell 18 and by a rear half-shell 20.

The front half-shell 18 comprises an axial, skirt-shaped front portion 22 which surrounds the front ends of the electrical contact elements 14. The skirt 22 is extended rearwards by a plate-shaped portion 24 which extends in a radial plane and which is fixed by crimping to the corresponding radial plate 26 of the rear half-shell 20. The plate-shaped portion 26 is extended axially rearwards by an axial skirt 28.

The metal shielding housing is here fixed on a printed circuit board 30 by means of brackets 32 and fixing pins 34.

In order to provide it with insulation, the front half-shell 18 is capped by a cap in moulded plastic material 36 which completely surrounds the peripheral metal surfaces of the front half-shell 18.

To this end, the insulating cap 36 comprises a front, skirt-shaped axial part 38 and a rear, radial, plate-shaped part 40.

The part 40 is extended axially rearwards by an axial edge 42 which covers and surrounds the facing peripheral edges of the fixing plates 24 and 26 of the two half-shells.

The fastening of the cap 36 onto the connector element 10 is provided by means of fastening lugs 44 which extend radially inwards from the peripheral edge 42 of the cap in such a way as to come to interact with the rear face of the radial fixing plate 26 of the rear half-shell 20.

Due to the thinness of the various parts of the cap, the bulk of the connector element, at its front part, is increased only very slightly and it is possible to equip the element 10, which is already installed on the plate 30, by capping it from the front by making the cap 36 pass into the standard opening 50 formed for example in a panel 52 of an electrical equipment rack.

At the end of the operation to put the cap 36 in place, the lugs 44 come to clip elastically around the edges of the two plates 24 and 26 which are received in the final notches 45 by the lugs 44, and by the rear face 41 of the plate-shaped part 40.

If the front half-shell 18 comprises two frontal screws 54, situated on either side of the skirt 22, in order to ensure locking in coupled position for the connector of which the element 10 forms part, the cap comprises two complementary cylindrical parts 56 which surround the screws 54.

The invention finds an application for numerous types of connectors, which are to be soldered, to be brazed, or to be through-mounted, etc.

I claim:

1. An electrical conductor element (10) of the type comprising an insulating block (12) which has a front region and which receives electrical contact elements (14) that extend through the insulating block, and a metal shielding cover which at least partially surrounds said front region of said insulating block and which is designed to be joined with the corresponding part of a complementary connector element, characterized in said connector element comprises a cap (36) of insulating material which is attached to the front part (18) of the said shielding cover;

said metal shielding cover comprises a front half-shell (18) and a rear half-shell (20), with said insulating cap (36) surrounding said front half-shell (18);

said front half-shell (18) comprises an axial, skirt-shaped portion (22) which extends substantially from the front face (16) of the insulating block (12) to surround the connection region of the electrical contact elements (14) and a radial, plate-shaped portion (24) which extends in a plane perpendicular to the axes of the electrical contact elements, said plate-shaped portion (24) being connected to a complementary plate (26) of the rear half-shell (20), and said insulating cap (36) comprises axial, skirt-shaped (38) and radial, plate-shaped (40) parts which surround corresponding parts of the front half-shell (18);

said plate-shaped radial part (40) of said insulating cap (36) comprises a rear axial edge (42) which surrounds the peripheral edges of the radial portions (24, 26) of the front half-shell (18) and of the rear half-shell, and said axial edge (42) comprises radial lugs (44) for fastening the cap (36) which interact with the rear face of the plate-shaped portion (26) of the rear half-shell (20).

2. Connector element according to claim 1 characterized in that the front face of the plate-shaped portion (24) of the front half-shell (18) comprises metal means (54) for coupling the connector element (10) with the complementary connector element, and in that the insulating cap (36) comprises complementary parts (56) which surround the said coupling means.

3. Connector element according to claim 2, characterized in that the said coupling means comprise two threaded members which extend axially from the front face of the plate-shaped portion of the front half-shell and which are arranged on either side of the skirt-shaped portion.

* * * * *